United States Patent [19]

Peters

[11] Patent Number: 4,783,742

[45] Date of Patent: Nov. 8, 1988

[54] APPARATUS AND METHOD FOR GRAVITY CORRECTION IN BOREHOLE SURVEY SYSTEMS

[75] Inventor: Rex B. Peters, Woodinville, Wash.

[73] Assignee: Sundstrand Data Control, Inc., Redmond, Wash.

[21] Appl. No.: 948,100

[22] Filed: Dec. 31, 1986

[51] Int. Cl.[4] ..... G01V 19/02; G01C 9/08; E21B 47/00

[52] U.S. Cl. ..... 364/422; 73/151; 73/505; 73/510; 33/304

[58] Field of Search ..... 364/422; 73/509, 517, 73/505, 510, 151; 33/304

[56] References Cited

U.S. PATENT DOCUMENTS

| | | | |
|---|---|---|---|
| 4,293,046 | 10/1981 | Van Steenwyk | 33/304 |
| 4,362,054 | 12/1982 | Ringot | 364/422 |
| 4,457,077 | 7/1984 | Lantzenhiser | 33/304 |
| 4,459,759 | 7/1984 | Hulsing | 33/304 |

FOREIGN PATENT DOCUMENTS

| | | | |
|---|---|---|---|
| 2029582 | 3/1980 | United Kingdom | 73/509 |

*Primary Examiner*—Jerry Smith
*Assistant Examiner*—Gail O. Hayes
*Attorney, Agent, or Firm*—Christensen, O'Connor, Johnson & Kindness

[57] ABSTRACT

Disclosed is an inertial navigation borehole survey system wherein the signals supplied by accelerometers (40) that are contained within the borehole survey system probe (10) are corrected for gravitational gradients encountered as the probe (10) travels through a borehole (12). The gravity correction is effected in the survey system signal processor (24) and is based on a gravity gradient signal that mathematically corresponds to:

$$\frac{\Delta f}{\Delta H} = \frac{f_o}{R_o}\left(-2 + 3\frac{\rho(H)}{\rho_{ave}}\right)$$

where f represents the specific force due to gravity; $f_o$ represents the specific force of gravity at wellhead (20) of borehole (12); $R_o$ represents the average radius of the earth; $\rho(H)$ represents the local density of the geological formation penetrated by the borehole as a function of depth H; and $\rho_{ave}$ represents the means density of the earth. In utilizing the gravitational gradient to generate a gravity correction signal, the signal processor (24) effects a summation process that mathematically corresponds to:

$$f(H) = \sum_{i=1}^{n}\left(\frac{\Delta f}{\Delta H}\right)_i (\Delta H)_i + f_o$$

where $(\Delta H)_i$ represents the depth change between the "ith" signal processing cycle and the nextmost antecedent processing cycle, and, the summation range extends from the first signal processing cycle performed during the borehole survey through the final signal processing cycle of the borehole survey operation.

5 Claims, 3 Drawing Sheets

APPARATUS AND METHOD FOR GRAVITY CORRECTION IN BOREHOLE SURVEY SYSTEMS

TECHNICAL FIELD

This invention relates to inertial navigation systems and, more particularly, to gravity compensation of inertial navigation systems that operate below the surface of the earth.

BACKGROUND OF THE INVENTION

The primary input signals to inertial navigation systems are provided by inertial angular sensors such as gyros that provide attitude information and by rectilinear motion sensors such as accelerometers, with the sensor signals being continuously processed to provide signals representative of the position of the vehicle or object that carries the navigation system. In this regard, displacement of the vehicle or object in a given direction basically is determined by integration of acceleration in that direction twice with respect to time.

When navigating in the vicinity of a large mass such as the earth, the signals provided by the accelerometers must be compensated or corrected for the gravitational potential of the earth. More specifically, the signal supplied by a conventional accelerometer represents both specific force asserted on the accelerometer as a result of actual acceleration of the vehicle or object carrying the navigation system and, in addition, specific force asserted on the accelerometer as a result of the earth's gravitational field. Thus, when the vehicle or object carrying the accelerometer is freely falling under the force of gravity, the acceleration of the vehicle is purely gravitational and an accelerometer that includes no compensation or bias to offset the force of gravity supplies no output signal. Conversely, an unbiased accelerometer that is held stationary with its sensitive axis pointing toward the center mass of the earth provides a signal having a magnitude that represents gravitational acceleration at the location of the accelerometer and a sign (e.g., polarity) that indicates that the measured gravitational acceleration is away from the center of the earth. Accordingly, unless a navigation system includes appropriate correction for gravitational field, a system utilizing an unbiased accelerometer will provide a false indication that the vehicle or body carrying the system is accelerating upwardly. Since the gravitational field of the earth (and other large masses that affect the navigation process) is not uniform, simply biasing or correcting accelerometer signals for a single value of gravity will not suffice, except in the least demanding situations.

Considerable effort has been expended both with respect to theoretical analysis and emperical observation with regard to accurately determining gravitational field at and above the surface of the earth. Based on the information made available by these efforts, signal processing techniques have been developed and implemented in inertial guidance systems that operate above the surface of the earth to accurately account for gravitation effect. However, these techniques do not apply to inertial navigation systems that are utilized below the surface of the earth. One example of such a system is the type of borehole survey system that utilizes strapdown inertial guidance techniques to determine the course of a borehole (e.g., oil well) as a tool or probe that contains gyros and accelerometers is continuously moved along the borehole by a support cable.

In such a borehole survey system, continuous movement of the probe precludes accelerometer signal correction based on in situ measurement of gravitational acceleration that is made during the surveying operation. On the other hand, although the acceleration signals provided by the survey probe can be corrected for gravitational acceleration at the well head (surface of the earth), this simple form of correction often is not sufficient. Specifically, such correction does not account for variation in gravitational acceleration as a function of probe depth nor does it account for changes in gravitational acceleration that result from density differences between the stratified layers of earth and rock that are typically encountered as the probe passes along the borehole (earth mass anomalies).

Modern borehole practice, including the drilling of very deep, small diameter deviated oil wells has created an ever increasing need for more compact and precise borehole survey systems. One aspect of fulfilling this need is the requirement for a signal processing arrangement that is operable within a borehole survey system (and other types of subterranean inertial navigation systems) to provide gravity compensation that is based on depth related gravitational field gradients and, in many situations, gradients caused by density variations in the geological formation that is penetrated by the borehole.

SUMMARY OF THE INVENTION

In accordance with this invention, gravity correction is achieved within a borehole survey system (or other type subterranean inertial navigation system) by continuous, sequential signal processing that provides a signal representative of the gravitational force asserted on the probe (or other object) that is being navigated. The signal thus obtained is processed in conjunction with probe acceleration and angular rate signals to provide signals representative of probe position, including vertical distance between the probe and the surface of the earth (probe depth). During each cycle of the signal processing, the probe depth signal is combined with signals representative of the force of gravity at the surface of the earth and, preferably, a signal representative of the density of the geological strata for the current probe depth to supply a new estimate of the gravitational force being asserted on the probe. Thus, in effect, the invention forms a continuous feedback loop.

In the practice of the invention, the gravity signal is based on a gravity gradient signal, $\Delta f/\Delta H$, that mathematically corresponds to $$\frac{\Delta f}{\Delta H} = \frac{f_o}{R_o}\left(-2 + 3\frac{\rho(H)}{\rho_{ave}}\right)$$

where

- f represents the specific force due to gravity (e.g., in microg);
- $f_o$ represents the specific force due to gravity at the surface of the earth (e.g., in microg);
- $R_o$ represents the average radius of the earth (6370 km);
- $\rho(H)$ represents the local density of the geological formation penetrated by the borehole as a function of distance below the earth's surface (e.g., in grams/cm$^3$);

$\rho_{ave}$ represents the mean density of the earth (approximately 5.517 grams/cm$^3$); and, the depth change parameter H is measured from the center of the earth and, by definition, is positive for probe travel toward the surface of the earth. In utilizing the gravitational gradient to generate the gravity signal, the signal processing performed in the practice of the invention affects a summation process (integration) that mathematically corresponds to $$f(H) = \sum_{i=1}^{n} \left( \frac{\Delta f}{\Delta H} \right)_i (\Delta H)_i + f_o$$

where $(\Delta H)_i$ represents the depth change between the "ith" signal processing cycle and the next most antecedent signal processing cycle (i.e., the "(i-1)th" signal cycle); and, the summation range extends from the first signal processing computational cycle performed below the surface of the earth (i=1) to the last (i=n) signal processing cycle that is performed as the probe is moved downwardly along the borehole.

In situations in which the density of the geological formation penetrated by the borehole is relatively constant, an average density value can be stored in the navigation system memory and utilized in the signal processing sequence. In situations in which there is substantial variation in density over the depth of the borehole, a series of density values can be stored in the navigation system memory in the form of a lookup table. Since borehole survey systems and other navigation systems that advantageously can employ the invention are aligned or initialized at the surface of the earth when each survey navigational operation is instituted, the specific force due to gravity at the earth's surface ($f_o$) can be stored in system memory during the initialization procedure.

BRIEF DESCRIPTION OF THE DRAWINGS

The aforementioned advantages and features of the invention and others will be apparent to one skilled in the art upon reading the following description in conjunction with the accompanying drawings in which.

DETAILED DESCRIPTION

Figure 1:
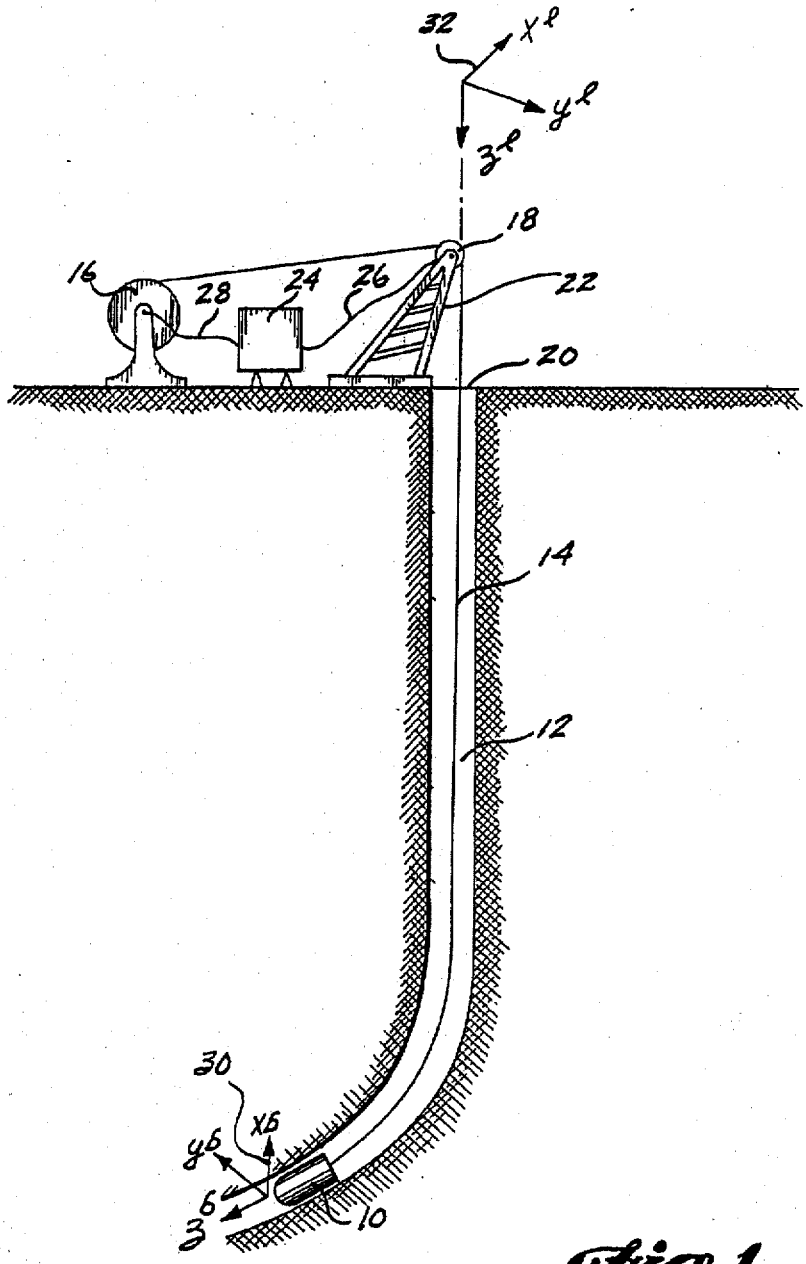
FIG. 1 schematically illustrates the borehole survey system of a type that can advantageously employ the invention.

FIG. 1 schematically illustrates a borehole survey system of a type that can advantageously employ the invention. In FIG. 1, a borehole survey probe 10 of an inertial borehole survey system is supported in a borehole 12 by means of cable 14 of conventional construction (e.g., a multi-strand flexible steel cable having a core that consists of one or more electrical conductors). The upper end of cable 14 is connected to a rotatable drum of a cable reel 16 that is positioned near borehole 12 and is utilized to raise and lower probe 10 during a borehole survey operation.

Cable 14 that is payed out or retrieved by cable reel 16 passes over an idler pulley 18 that is supported above wellhead 20 of borehole 12 by a conventionally configured cable measurement apparatus 22. Idler pulley 18 is of known radius and electrical circuitry is provided (not shown) for supplying an electrical pulse each time idler pulley 18 is rotated through a predetermined arc.

As is indicated in FIG. 1, the signal pulses supplied by cable measurement apparatus 22 are coupled to a signal processor 24 via a signal cable 26. Signal processor 24, which is connected to cable reel 16 by a signal cable 28, transmits control signals to and receives information signals from probe 10 (via the electrical conductors of cable 14 and signal cable 28). In addition, signal processor 24 sequentially processes the signals supplied by probe 10 and cable measurement apparatus 22 to accurately determine the position of probe 10. As is known in the art, signals can be transmitted between signal processor 24 and probe 10 by other means such as pressure impulses that are transmitted through the fluid or drilling mud that fills borehole 12 rather than by means of cable 14.

In strapdown inertial borehole survey systems probe 10 includes an accelerometer cluster (not depicted in FIG. 1) that provide signals representative of probe acceleration along the axes of a Cartesian coordinate system that is fixed relative to probe 10 and includes a gyroscope cluster (not depicted in FIG. 1) that provides signals representative of the angular rotation of probe 10 about the same coordinate axes. In FIG. 1, the strapdown coordinate system for probe 10 is indicated by the numeral 30 and consists of a right hand Cartesian coordinate system wherein the z axis ($z^b$) is directed along the longitudinal centerline of probe 10 and the x and y axes ($x^b$ and $y^b$) lie in a plane that is orthogonal to the longitudinal centerline of probe 10. The coordinate system 30 that is associated with probe 10 is commonly called the "probe body" or "body" coordinate system and signal processor 18 processes the probe body coordinate acceleration and angular rate signals provided by the accelerometer and gyroscope clusters of probe 10 to transform the signals into positional coordinates in a coordinate system that is fixed relative to the earth. The coordinate system that is fixed relative to the earth is commonly called the "earth" or "local level" coordinate system and is indicated in FIG. 1 by the numeral 32. In local level coordinate system 32 of FIG. 1, the $z^l$ axis extends downwardly and passes through the center of the earth and the $x^l$ and $y^l$ axes correspond to two orthogonal directions (e.g., north and east, respectively).

As also is known, the probe body coordinate acceleration and velocity signals can be transmitted directly to signal processor 24 via the conductors within cable 14 (or other conventional transmission media) or can be accumulated within a memory unit (not shown in FIG. 1) that is located within probe 10 and either transmitted to signal processor 24 as a series of information frames or retrieved for processing when probe 10 is withdrawn from borehole 12. In addition, if desired, probe 10 can include a microprocessor circuit for effecting at least a portion of the signal processing that is otherwise performed by signal processor 24. In any case, sequentially processing the signals supplied by the accelerometer and gyroscope clusters of probe 10 provides $x^1$, $y^1$, $z^1$ coordinate values for the position that probe 10 occupies in borehole 12. When probe 10 is moved along the entire length of borehole 12 by means of cable 14, the coordinate values thus obtained collectively provide a three-dimensional map or plot of the path of borehole 12.

Figure 2:
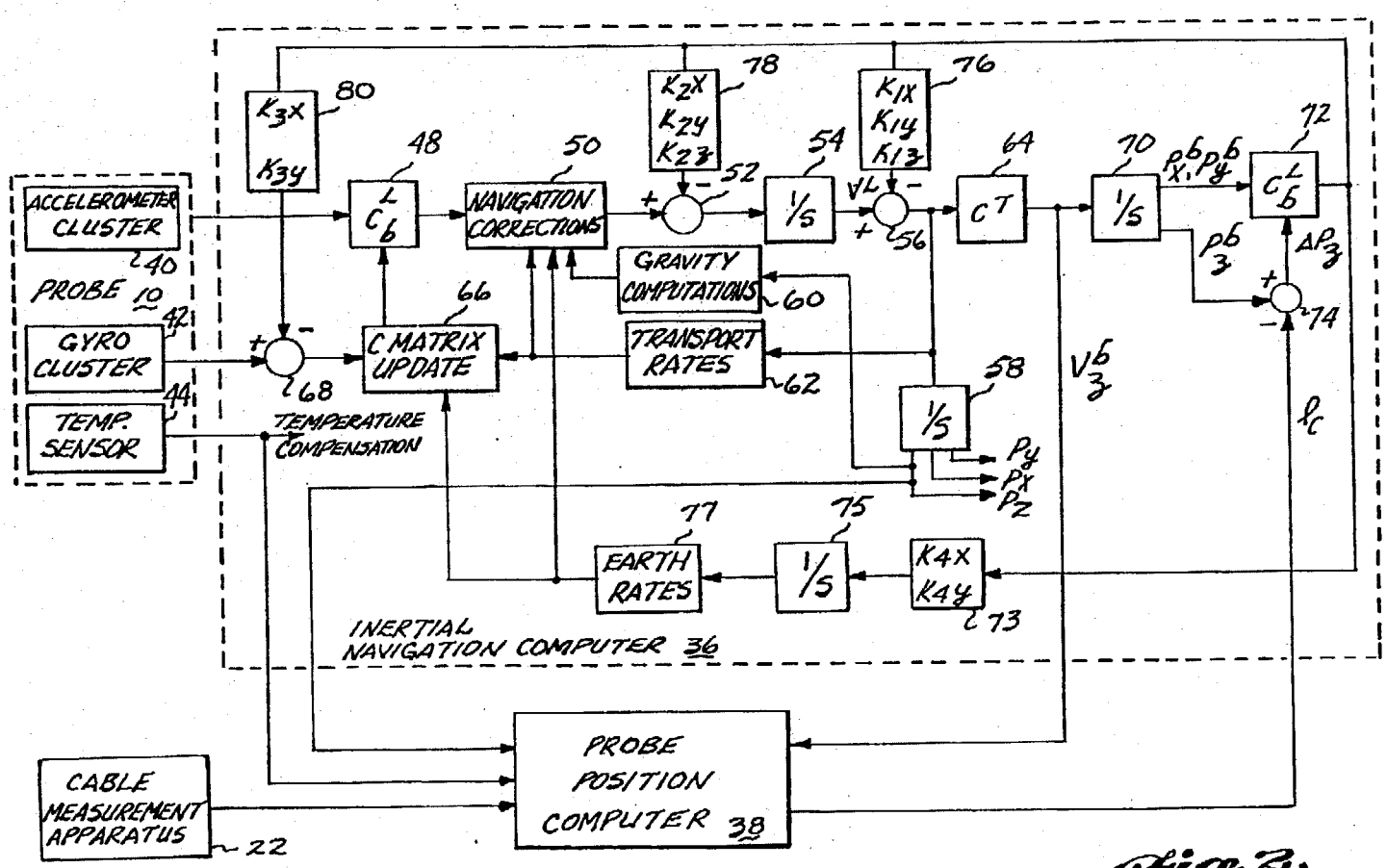
FIG. 2 is a block diagram that illustrates the invention incorporated in a signal processing arrangement for performing inertial navigation in the type of borehole system that is illustrated in FIG. 1; and, FIG. 3 is a block diagram that illustrates in greater detail the manner in which the invention operates in conjunction with a typical inertial navigation system to provide a gravity compensation loop.

FIG. 2 illustrates one type of arrangement for performing the inertial navigation signal processing required in the strapdown borehole navigation system of FIG. 1 and also generally illustrates the interconnection of the invention with that arrangement for performing gravity-corrected inertial navigation signal processing. Specifically, FIG. 2 depicts a borehole navigation system that generally corresponds to the type of system disclosed in the United States patent application of Rand H. Hulsing II, entitled "Borehole Survery System Utilizing Strapdown Inertial Navigation," Ser. No. 948,058, filed Dec. 31, 1986, and assigned to the assignee of this invention. As shall be recognized upon understanding the invention and the borehole navigation system of FIG. 2, the invention can be utilized in numerous other situations, in which inertial navigation is effected below the surface of the ground.

In FIG. 2, the inertial navigation portion of the required signal processing (performed, for example, by signal processor 24 of FIG. 1) is illustrated within a dashed outline that is identified as inertial navigation computer 36. A probe position computer 38 performs signal processing operations that provides a signal that accurately represents the distance (path length) between tool 10 and wellhead 20 of FIG. 1. This signal, denoted $l_c$ in FIG. 2, is utilized in the depicted arrangement as a navigational aiding signal that corrects for errors that would otherwise occur in the inertially derived velocity and position signals.

As is shown in FIG. 2, signals are coupled to inertial navigation computer 36 by an accelerometer cluster 40, a gyrocluster 42 and a temperature sensor 44, each of which is located within probe 10. The signals provided by temperature sensor 44 are utilized within inertial navigation computer 36 (and/or within probe 10) to effect compensation for temperature dependencies of the signals provided by accelerometer cluster 40, and gyrocluster 42 also is utilized by probe position computer 38 in compensating for temperature induced stretching of cable 14.

The probe body coordinate acceleration signals supplied by accelerometer cluster 40 are coupled to block 48 of inertial navigation computer 36. The probe body coordinate acceleration signals are processed at block 48 to transform the acceleration signals from the body coordinate system (coordinate system 30 of FIG. 1) to the local level coordinate system (coordinate system 32 of FIG. 1). As is indicated in FIG. 2, the signal processing involved in transforming the body coordinate acceleration signals to the level coordinate system corresponds to multiplying each set of body coordinate acceleration signals (x, y and z components) by a probe body to level coordinate transformation matrix, $C_b^L$.

As is indicated by navigation correction block 50 of FIG. 2, the level coordinate acceleration signals which result from the coordinate transformation performed at block 48 are corrected for a Coriolis effect, centrifugal acceleration and the variation in gravitational force on probe 10 with respect to depth. The corrected level coordinate probe acceleration signals that result from the navigation correction performed at block 50 are further corrected by subtraction of velocity error signals within a signal summer 52.

As indicated by integrator 54 of FIG. 2, the resulting signals are then integrated to supply a set of level coordinate velocity signals $v^L$. The probe level coordinate velocity signals are then corrected by subtraction of a set of position error signals (in signal summer 56 in FIG. 2) and the resulting set of signals are supplied to an integrator 58, which produces the system output signals $P_x$, $P_y$, $P_z$ (which represent the position of probe 10 in the local level coordinate system). As can be seen in FIG. 2, the $P_z$ signal is coupled to probe position computer 38 and, in addition, is coupled to a gravity computations block 60. As shall be described in greater detail, gravity computations block 60 operates in accordance with this invention to supply signals to navigation correction block 50 which correct the probe acceleration local level coordinate signals for changes in gravitational force that occur as a function of probe depth.

As also is shown in FIG. 2, in the depicted inertial navigation computer 36, the probe level coordinate velocity signals also are supplied to a transport rates block 62 and a transformation block 64. The signal processing performed at transport rates block 62 compensates the probe acceleration signals for centrifugal acceleration and provides an input signal to navigation correction block 50 and C matrix update block 66. As previously mentioned, navigation correction block 50 represents the signal processing that corrects the probe acceleration level coordinate signals for various factors such as Coriolis effect and utilizes the present invention to compensate for changes in gravitation force as probe 10 traverses borehole 12. For example, in the previously referenced patent application of Rand Hulsing III, a portion of the signal processing that is effected in navigation correction block 50 corresponds to the mathematical expression:

$$\dot{v}^L = C_b^L A^B - (2\omega_{IE}^L + \omega_{EL}^L) \times v^L - G^L$$

where $\omega_{IE}^L$ represents current values of the signals supplied by earth rates block 77 (in the level coordinate system);

$\omega_{EL}^L$ represents the current level coordinate system values of the signals supplied by transport rates block 62;

x denotes the vector cross-product operation;

$A^B$ is a vector comprising the current values of probe acceleration in the probe body coordinate system (32 in FIG. 1); and $$G^L = \begin{bmatrix} 0 \\ 0 \\ g_z^L \end{bmatrix}$$

where $g_z^L$ represents acceleration due to gravity for the current depth of probe 10, i.e., a signal provided by gravity computations block 60 in accordance with the present invention.

The signal processing represented by C matrix update block 66 provides new coefficient values for the $C_b^L$ matrix described relative to transformation block 48 with each cycle of the signal processing sequence. As is indicated in FIG. 2, a signal summer 68 provides an additional input signal to C matrix update block 66 which is equal to the difference between the rate signals supplied by gyrocluster 42 of probe 10 and tilt error rate signals (X and Y level coordinates only).

The signal processing performed at transform block 64 transforms the probe velocity level coordinate signals supplied by signal summer 56 into the probe body coordinate system for signal processing that will result in the above-mentioned tilt error rate signals, velocity error signals and position error signals. As is indicated in block 64 of FIG. 2, this transformation corresponds to multiplication of the probe level coordinate velocity signals (in matrix form) by the mathematical transpose ($C^T$) of the probe body to level coordinate transform matrix ($C_b^L$), which was discussed with respect to transform block 48. The probe body coordinate velocity signals that result from the transformation effected at block 64 are supplied to an integrator 70, with the Z-axis component thereof ($v_z^b$) also being supplied to probe position computer 38.

The signal processing that generates the navigation system tilt error rate signals, velocity error signals and position error signals is indicated at block 72 of FIG. 2 and consists of transformation of the probe body coordinate position signals into the level coordinate system. As is indicated at block 72, the transformation mathematically corresponds to matrix multiplication of the probe position signals (in the probe body coordinate system) by the previously discussed transformation matrix $C_b^L$. In the currently preferred embodiments of the invention, the elements of this transformation matrix and the above-discussed signal processing are established on the basis of an error model which implements a minimum variance estimate of the system state by means of Kalman filtering techniques. Such implementation is known in the art and is described, for example, in U.S. Pat. No. 4,542,647.

In the arrangement of FIG. 2, the signals that result from the signal transformation indicated at block 72 are processed to: (a) provide the position error signals to signal summer 56 by multiplying the X, Y and Z level coordinate position error values by suitable coefficients $K_{1x}$, $K_{1y}$ and, $K_{1z}$ (indicated at block 76); (b) provide the velocity error signals to signal summer 52 by muliplying the level coordinate position error values by suitable coefficients $K_{2x}$, $K_{2y}$ and, $K_{2z}$ (indicated at block 78); and, (c) provide the tilt error rate signals to signal summer 68 by multiplying the X and Y components of the level coordinate position error signals by suitable coefficients $K_{3x}$, and $K_{3y}$ (indicated at block 80 of FIG. 2).

In addition, the X and Y components of the signals provided by transformation block 72 are: multiplied by suitable coefficients, $K_{4x}$ and $K_{4y}$ (at block 73); integrated (at block 75); and supplied to earth rates block 77. Earth rates block 77 supplies a signal to navigations corrections block 50 and C-matrix update block 66 to provide correction for Coriolis effect. Generally, such correction is quite small, so $K_{4x}$ and $K_{4y}$ are relatively small and, in some situations, may be zero.

With respect to the arrangement of FIG. 2, it can be noted that the probe body X and Y level coordinate position signals are directly transformed (i.e., supplied to transformation block 72 of FIG. 2 by integrator 70), whereas the probe body Z coordinate position is processed to provide a position error signal $\Delta P_z$, which is supplied to transformation block 72. More specifically, probe position computer 38 supplies a signal $l_c$, which is a precise estimate of the path length of that portion of borehole 12 that extends between wellhead 20 and probe 10. This precise path length estimate is subtracted from the inertially derived body coordinate position signal $P_z^b$ (in signal summer 74) to produce the position error signal $\Delta P_z$.

Various arrangements have been proposed for utilization in borehole survey and logging systems to provide a signal representative of the path length between a probe and the borehole wellhead based on cable length measurement signals such as the signals provided by cable measurement apparatus 22 of FIG. 2. One type of such an arrangement is disclosed in the United States patent application of Rex B. Peters, entitled "Apparatus and Method for Determining the Position of a Tool in a Borehole," Ser. No. 948,323, filed Dec. 31, 1986, and assigned to the assignee of this invention. However, the arrangement of this invention of gravity correction of the navigation system accelerometer signals is not dependent upon or related to the operation of probe position computer 38 of the system depicted in FIG. 2. In this regard, the invention can be employed in systems that do not employ the navigational aiding loop formed by probe position computer 38, as well as systems that incorporate aiding loops of a different nature. Accordingly, reference need not be taken to sources such as the above-referenced patent application of Rex B. Peters to obtain information that is essential to the practice of this invention.

The signal processing utilized in accordance with the invention to provide gravity compensation can be understood by considering a model in which the probe is considered to be a point mass and the earth is represented by a sphere having a density that is a function of radius only (i.e., a spherically symmetric earth model). Conceptually, the model can be further simplified by analogy to a spherical mass distribution and a spherical charge distribution, since such an analogy readily results in the observation that mass shells which are at a greater radius than the point of measurement (i.e, the radial position of the probe within the spherical earth model) result in no contribution to the force asserted at the point of measurement, while mass shells of lesser radius in effect behave as point masses concentrated at the center of the shells (i.e., the center of the spherical earth model). Based on such a spherically symmetric model and this analogy, it thus becomes apparent that the specific force f(R) acting on a measurement point at the radius R is $$f(R) = M(R)G_o/R^2 \tag{1}$$

where $G_o$ represents the universal gravitational constant; and

M(R) represents the mass within a spherical volume of radius R, which is given by the mathematical expression $$M(R) = \int_0^R \rho(r)4\pi r^2 dr \tag{2}$$

When a force $f(R_o)$ that is asserted on a measurement point located at a radius $R_o$ is known (e.g., the force asserted at the surface of the earth model), equation (2) may be written $$f(R) = \frac{R_o^2 \int_o^R \rho(r) r^2 dr}{R^2 \int_o^{R_o} \rho(r)^2 dr} f(R_o) \quad (3)$$

or, alternatively, as $$f(R_o) - f(R) = f(R_o)\left[1 - \frac{R_o^2}{R^2} + \frac{R_o^2 \int_R^{R_o} \rho(r)(r^2/R^2)dr}{R^2 \int_0^{R_o} \rho(r)(r^2/R_o)dr}\right] \quad (4)$$

since boreholes typically have a depth less than 35,000 feet (approximately 10 Km) and the average radius of the earth is approximately 6370 Km, a boundary condition for the model under consideration is $R_o - R << R_o$. Applying this boundary condition to equation (4) yields $$f(R_o) - f(R) \approx \frac{f(R_o)}{R_o}(R_o - R)\left(-2 + \frac{3\rho(R)}{\rho_{ave}}\right) \quad (5)$$

where $\rho_{ave}$ denotes the mean density of the earth and is given by the expression $$\rho_{ave} = \frac{3}{4\pi R_o^3} \int_0^{R_o} \rho(r) 4\pi r^2 dr$$

Thus, in accordance with the model and boundary conditions under consideration, the variation and gravitational acceleration is $$\frac{\Delta f}{\Delta H} = \frac{f_o}{R_o}\left(-2 + \frac{3\rho(R)}{\rho_{ave}}\right)$$

where f represents the specific force due to gravity (e.g., in microg)

$f_o$=specific force due to gravity at the surface of the earth (e.g., in microg)

$\Delta f$=change in specific force for a depth change of $\Delta H$, with $\Delta H$ being positive in the direction away from the center of the earth and being expressed in Km;

$R_o$=radius of the earth (approximately 6370 Km);

$\rho$=local density of the geological formation penetrated by the borehole (e.g., in grams/cm$^3$); and, $\rho_{ave}$=mean density of the earth, which is given by the above-noted expression and which is approximately 5.517 grams/cm$^3$.

The viability of the gravitational gradient expression resulting from the above-discussed spherical-layered density earth model for gravity correction within a borehole survey system can be demonstrated by considering a locally flat earth model, i.e., a model in which the borehole extends partially along the central axis of a horizontally oriented disc. For such a model, it can be shown that the change in gravitational force $\Delta f$ is given by the expression $$\frac{\Delta f}{h} \approx -4\pi\rho G_o(1 + h/2\, r_o)$$

where h is the depth parameter;

z denotes the vertical distance variable, which is measured upwardly from the reference point and is less than h; and, r represents horizontal radius.

When the integration is carried out to a finite radius $r = r_o$ instead of $r = \infty$, this model yields $$\Delta f = -2 \int_o^h \int_o^\infty \frac{2\pi\rho G_o r z}{(r^2 + Z^2)^{3/2}} dr\, dz$$

Thus, for example, a depth of h of five miles (approximately 8 Km) and a radius of $r_o$ of fifty miles (approximately 80 Km) results in a nominal gravitational variation of approximately 0.1 microg/foot (approximately 3.2 millig/Km). Further, a 100% density step beyond radius $r_o$ yields a change of 0.005 microg/foot (16 microg/Km), whereas a 10% density step would alter the result obtained from that assumed for a worldwide geological layer by 0.0005 microg/foot (1.6 microg/Km).

Thus, it can be recognized that the gravitational gradient expression derived on the basis of the layered spherical earth model is valid within about 1 microg per kilometer if the density of the geological layer at any depth penetrated by the borehole is constant to within about ±10% out to a radius of 50 miles (80 Km). As also can be seen from the above evaluation of the expression obtained on the basis of the locally flat earth model, large density changes at a radius that exceeds 50 miles from any position along the borehole have little effect on the gravitational gradient given by the expression that is based on the previously discussed layered density spherical earth model.

Numerical examples of the gravitational gradient that results for typical geological density values are useful in further understanding the invention. Specifically, all currently contemplated borehole drilling is located above the Mohorovicic Discontinuity ("Moho"), which varies from about 10 Km to about 35 Km in depth. The density variation for geological strata within this depth range varies between about 1.9 g/cm$^3$ (light sedimentary surface rock) and 2.8 g/cm$^3$ (heavy metamorphic rock or basalt), with most geologic layers having a density on the order of 2.5 g/cm$^3$. Thus, substitution of these values in equation (6) yields a gravitational gradient $\Delta f/\Delta H$ of −153 microg/Km (−0.047 microg/foot) for a density of 1.9 grams/cm$^3$; a value of −75 microg/Km (−0.023 microg/foot) for a density of 2.8 grams/cm$^3$; and a gravitational gradient of −101 microg/Km (−0.0.031 microg/foot) for a density of 2.5 grams/cm$^3$. It is of interest to note that these gravitational gradient values range from about ¼ to about ⅛ of the free air gradient (which is obtained when the density is equal to 0), with a mean value of about ⅓ the free air gradient. Additionally, it can be noted that these gravitational gradients substantially differ from the free air gradient of −315 microg/Km, which is commonly utilized with respect to navigation systems that operate above the surface of the earth. Further, the gravitational gradients that result from the above-discussed application of equation (6) significantly differ from a gravitational gradient of +158 microg/Km, which would result if the density of the earth were constant.

Figure 3:
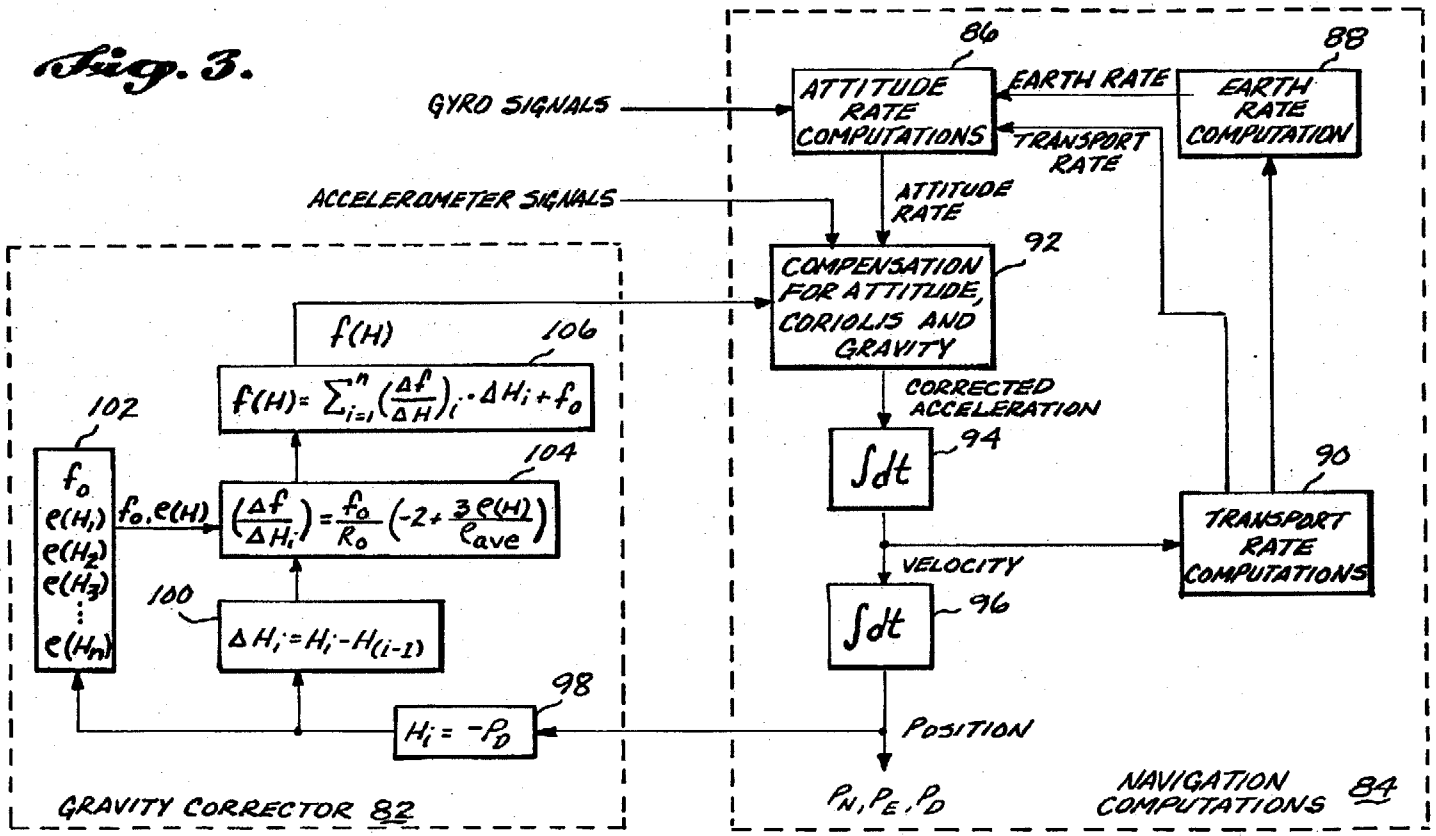

The manner in which the above-described estimate of the gravitational gradient $\Delta f/\Delta H$ is utilized in practicing the invention can be understood with reference to FIG. 3, which diagrammatically depicts the navigational signal processing that is implemented during each processing cycle of a borehole survey system that is configured in accordance with the invention (e.g., signal processor 24 of FIG. 1). In FIG. 3, signal processing that generates the gravity correction signal is indicated within a dashed outline that is identified as gravity corrector 82, and signal processing that is typical to borehole navigation systems of the type depicted in FIG. 2 is indicated within a dashed outline that is identified as navigation computations 84. In this regard, navigation computations block 84 FIG. 3 generically corresponds to the borehole survey arrangement of FIG. 2, without depicting the previously described cable length navigational aiding loop or other aiding loops that can be employed in borehole navigational systems.

As was discussed relative to the arrangement of FIG. 2 and as is more clearly shown in FIG. 3, during each signal processing computational cycle, the system gyro signals are processed (within attitude rate computation block 86) to determine the current inertial attitude rate of the system probe. During each attitude rate computation sequence, an earth rate signal (provided by earth rate computation block 88) and a transport rate signal (provided by transport rate computation block 90) are utilized to update the attitude rate computation so that attitude rate is determined with respect to the desired inertial coordinate system (i.e., a locally level coordinate system is maintained).

As is indicated at block 92 of FIG. 3, the second primary signal processing sequence of each signal processing cycle utilizes the attitude rate signal, the current acceleration signals and the current value of the gravity correction signal provided by gravity corrector block 82 to determine the corrected or actual acceleration of the system probe with respect to the reference coordinate system. As is indicated by blocks 94 and 96, the acceleration signals are integrated twice with respect to time to provide velocity and position signals, with the velocity signal being provided to transport rate computation block 90 for use in supplying an updated transport rate signal. As is known to those skilled in the art, signal processing that corresponds to the mathematical operation of integration is performed by computational sequences that basically accumulate (sum) the product of signal samples representative of the parameter being integrated and signals representative of the time that elapses between signal samples (e.g., the signal processing cycle period).

As is indicated in navigation computations block 84 of FIG. 3, the probe position signals provided by integration block 96 typically include signals representative of probe position relative to a local level Cartesian coordinate system having an axis that extends downwardly toward the center of the earth and two axes that extend due north and due east. In borehole inertial navigation systems utilizing such a local level coordinate system, the first step of the gravity correction signal processing sequence is conversion of the current vertical component of probe position ($P_D$) into a current height signal $H_i = -P_D$ (indicated at block 98 of gravity corrector 82). The current height value ($H_i$) then is utilized at block 100 to determine the change in probe height occurring between the current signal processing cycle and the next most antecedent (or "(i−1)th") signal processing cycle and is utilized at block 102 to access the value of specific force at the surface of the earth ($f_o$) and the value of the density for the geological formation surrounding the system probe (i.e., density at depth $H_i$). As is indicated at block 102, the density values can be stored in the memory of the system signal processor in the form of a lookup table that contains a series of density values for the particular borehole being surveyed. These density values are determined by, for example, known borehole logging techniques and are entered in system memory prior to initiating the borehole survey by means of a conventional keyboard or other input device that is included in the system signal processor. Alternatively, in some situations, a single density value can be stored in the signal processor memory and utilized to generate the gravitational gradient signal without substantial loss of accuracy. The specific force due to gravity at the surface of the borehole also is stored in memory when the survey operation is initiated and can easily be determined, for example, during the probe alignment or initiation procedure that is conducted when a borehole survey is commenced.

Regardless of the manner in which the density values are stored and accessed, the next step of the depicted gravity correction signal processing sequence is calculation of the current value of the gravitational gradient $(\Delta f/\Delta H)_i$, which is indicated at block 104 of FIG. 3. Mathematically, this signal processing step corresponds to evaluation of the previously discussed equation (6). The gravitational gradient for the current borehole survey signal processing cycle is then added to the accumulated gravitational gradient signals obtained during prior signal processing cycles of the same borehole survey operation at block 106. That is, signal processing is effected that corresponds to $$f(H) = \sum_{i=1}^{n} \left(\frac{\Delta f}{\Delta H}\right)_i (\Delta H)_i + f_o$$

The specific force due to gravity for the current position of the probe, f(H), is then made available for the previously discussed accelerometer compensation that is indicated in block 92 of FIG. 3.

In view of the above set forth description, several aspects of the invention can be readily appreciated. Firstly, since borehole survey systems that utilize inertial navigation include a signal processor such as a programmed digital computer, the invention easily can be implemented using a keyboard and memory space of the survey system signal processor. In the same regard, the programming necessary to implement the invention is easily realized by those skilled in the art from the above discussion of gravity corrector 82 of FIG. 3. In addition, as can clearly be seen in FIG. 3, the invention, in effect, forms a signal processing feedback loop in which the accelerometer signals are compensated to correct for the gravitational field of the geological formation surrounding the survey probe (and other sources of navigation errors such as Coriolis effect and centrifugal acceleration); the corrected acceleration signals are integrated twice with respect to time to provide position signals that include a signal representative of probe depth; and the probe depth signal is processed (along with appropriate geological density values and the specific force value for the surface of the earth) to provide the gravity correction signal.

Although the invention has been described in terms of currently preferred embodiments, it should be understood that other and further modifications, apart from those described, may be made without departing from the scope and spirit of the invention, which is defined by the following claims.

The embodiments of the invention in which an exclusive property or privilege is claimed are defined as follows:

1. A gravity-compensated borehole survey system comprising:

a probe configured and arranged for passage along said borehole, said probe including acceleration sensing means for supplying acceleration signals representative of the specific force asserted on said probe and angular rate sensing means for supplying angular rate signals representative of angular rotation of said probe about predetermined axes;

a cable affixed to said probe for raising and lowering said probe through said borehole;

cable control means for paying out and retrieving said cable to lower said cable into and retrieve said probe from said borehole; and signal processing means connected for receiving said acceleration signals and said angular rate signals from said probe, said signal processing means providing:

(a) means for processing said acceleration signals and said angular rate signals during a series of repeated signal processing cycles to supply probe position signals representative of the position of said probe during each of said signal processing cycles, each of said probe position signals including a depth signal representative of the current vertical depth of said probe, said means for processing said acceleration signals and said angular rate signals being responsive to a gravity correction for correcting said acceleration signals relative to signal components that are attributable to gravitational force;

(b) means responsive to said depth signal for supplying a gravity gradient signal, said means for supplying said gravity gradient signal further being responsive to a signal representative of the density of the geological formations penetrated by said borehole at a depth corresponding to said current depth signal and being responsive to a signal representative of the gravitational force asserted on said probe when said probe is positioned at the surface of the earth near said borehole, said means for supplying said gravity gradient signal being configured and arranged so that the value of said gravity gradient signal is in substantial correspondence with the mathematical expression:

$$\frac{\Delta f}{\Delta H} = \frac{f_o}{R_o}\left(-2 + 3\frac{\rho(H)}{\rho_{ave}}\right)$$

where $f_o$ represents the gravitational force asserted on said object when said object is located on the surface of the earth and $\Delta f$ is a change in the gravitational force asserted on the probe as its vertical depth changes, $R_o$ represents the radius of the earth, $\rho(H)$ represents the density of the geological formation surrounding said object during the current signal processing cycle, $\rho_{ave}$ represents the average density of the earth, and $\Delta H$ represents a vertical displacement of the probe upwards;

(c) means responsive to said gravity gradient signal for supplying said gravity correction signal, said means for supplying said gravity correction signal being configured and arranged to supply said gravity correction signal in substantial accordance with the mathematical expression:

$$f(H) = \sum_{i=1}^{n}\left(\frac{\Delta f}{\Delta H_i}\right)(\Delta H)_i + f_o$$

where f(H) represents the gravity correction signal and the indicated summation represents accumulation of the product of the displacement, $\Delta H$, and the gravity gradient signal for each signal processing cycle.

2. The borehole survey system of claim 1, wherein said signal processing means further includes memory means for storing a predetermined number of said signals representative of said density of said geological formation penetrated by said borehole, with each said stored signal being representative of said density for a different value of said depth signal, said memory means being responsive to said depth signal to supply that one of said density signals that most closely corresponds to said current depth signal to said means for supplying said gravity gradient signal during each of said signal processing cycles.

3. A borehole inertial navigation system corrected for gravitational force, comprising:

(a) a movable probe including acceleration sensing means for sensing the acceleration to which the probe is subject and producing an acceleration signal responsive thereto, and angular rate sensing means for sensing the angular rate of rotation of the probe and producing a rate of rotation signal responsive thereto;

(b) means for moving the probe through a subterranean passage;

(c) processor means, connected to receive the acceleration signal and the rate of rotation signal, for determining the position of the probe, including its vertical depth as a function of said signals;

(d) gravity correction means for determining a gravitational correction as a function of:

(i) the vertical depth of the probe;

(ii) a density of earth strata at the probe's position in the subterranean passage;

(iii) a predetermined value for the force of gravity at a surface entrance to the subterranean passage; and, (iv) the vertical depth of the probe, said processor means being further operative to correct the position of the probe as a function of the gravitational correction.

4. A borehole inertial navigation system of claim 3, wherein the gravity correction means include memory means for storing the density of earth strata.

5. The borehole inertial navigation system of claim 4, wherein the memory means are operative to store a plurality of values for the density of the earth strata, varying as a function of the probe's depth in the subterranean passage.

* * * * *

UNITED STATES PATENT AND TRADEMARK OFFICE

CERTIFICATE OF CORRECTION

PATENT NO. : 4,783,742

DATED : November 8, 1988

INVENTOR(S) : R.B. Peters

It is certified that error appears in the above-identified patent and that said Letters Patent is hereby corrected as shown below:

56 References Cited, "Hulsing" should be --Hulsing, II--.
57 Abstract, Column 2, line 17, "means" should be --mean--.
57 Abstract, Column 2, line 29, "nextmost" should be --next most--.
Column 1, line 54, "emperical" should be --empirical--.
Column 2, line 17, after "wells", insert --,-- (comma).
Column 3, line 8, "affects" should be --effects--.
Column 3, lines 19-20, "(i-1)th" should be on the same line together.
Column 4, line 28, "provide" should be --provides--.
Column 4, line 35, "right hand" should be --right-hand--.
Column 4, line 42, "18" should be --24--.
Column 5, line 17, after "Hulsing", insert --,-- (comma).
Column 5, line 17, "survery" should be --survey--.
Column 5, line 30, "provides" should be --provide--.
Column 5, line 32, "tool" should be --survey probe--.
Column 5, line 33, "$1_c$" should be -- $\ell_c$--.
Column 5, line 46, "temperature induced" should be --temperature-induced--.
Column 6, line 34, "Hulsing III" should be --Hulsing, II--.
Column 6, line 51, "32" should be --30--.
Column 7, line 5, "transform" should be --transformation--.
Column 7, line 44, "muliplying" should be --multiplying--.
Column 7, line 55, "navigations" should be --navigation--.
Column 7, line 56, "C-matrix" should be --C matrix--.
Column 7, line 67, "$1_c$" should be -- $\ell_c$--.
Column 10, lines 1-4, "$\frac{\Delta f}{h} \simeq -4\pi\rho G_o(1+h/2r_o)$"

should be -- $\Delta f = -2 \int_0^h \int_0^\infty \frac{2\pi\rho G_o r z}{(r^2+z^2)^{3/2}}\, dr\, dz$ --

UNITED STATES PATENT AND TRADEMARK OFFICE

CERTIFICATE OF CORRECTION

PATENT NO. : 4,783,742

DATED : November 8, 1988

INVENTOR(S) : R.B. Peters

It is certified that error appears in the above-identified patent and that said Letters Patent is hereby corrected as shown below:

Column 10, lines 13-17,

" $\Delta f = -2\int_0^h \int_0^\infty \frac{2\pi\rho G_o r z}{(r^2+z^2)^{3/2}}\, dr\, dz$ "

should be -- $\frac{\Delta f}{h} \simeq -4\pi\rho G_o(1+h/2r_o)$ "--.

Column 10, line 57, "0.0.031" should be --0.031--.
Column 11, line 16, after "computations", insert --block--.
Column 11, line 17, before "FIG. 3", insert --in--.
Column 11, line 33, "locally" should be --local--.
Column 13, line 40, after "correction", insert --signal--.
Column 14, lines 15-16, " $\left(\frac{\Delta f}{\Delta H_i}\right)$ " should be -- $\left(\frac{\Delta F}{\Delta H}\right)_i$ --.

Signed and Sealed this

Fourth Day of July, 1989

*Attest:*

*Attesting Officer*

DONALD J. QUIGG

*Commissioner of Patents and Trademarks*